US010529202B1

(12) United States Patent
Baker, Jr.

(10) Patent No.: US 10,529,202 B1
(45) Date of Patent: Jan. 7, 2020

(54) MOTION DETECTOR ALERT DEVICE

(71) Applicant: Frank Baker, Jr., Mercer, PA (US)

(72) Inventor: Frank Baker, Jr., Mercer, PA (US)

( * ) Notice: Subject to any disclaimer, the term of this patent is extended or adjusted under 35 U.S.C. 154(b) by 0 days.

(21) Appl. No.: 15/997,865

(22) Filed: Jun. 5, 2018

(51) Int. Cl.
*G08B 13/18* (2006.01)
*G08B 3/10* (2006.01)
*G08B 21/22* (2006.01)

(52) U.S. Cl.
CPC ..... *G08B 13/18* (2013.01); *G08B 3/10* (2013.01); *G08B 21/22* (2013.01)

(58) Field of Classification Search
CPC ..... G08B 13/18; G08B 3/10; G08B 21/22
See application file for complete search history.

(56) References Cited

U.S. PATENT DOCUMENTS

D369,308 S 4/1996 Pun
5,619,185 A * 4/1997 Ferraro ..... G08B 13/1409 340/506
6,049,274 A 4/2000 Stachurski
6,696,971 B2 2/2004 Tukin
6,741,176 B2 5/2004 Ferraro
6,831,558 B1 * 12/2004 Andrew ..... A47G 29/1214 200/61.61
6,933,854 B1 * 8/2005 Burgess ..... G08B 7/06 340/691.1
7,466,239 B2 12/2008 Lewis
9,728,077 B1 * 8/2017 Fu ..... G08B 29/185
2007/0222577 A1 * 9/2007 Wilson ..... G08B 13/00 340/521
2008/0204258 A1 * 8/2008 Dayton ..... F21V 23/0442 340/600
2013/0257611 A1 * 10/2013 Lamb ..... G08B 13/02 340/501

FOREIGN PATENT DOCUMENTS

GB 2453902 3/2012

* cited by examiner

*Primary Examiner* — Mohamed Barakat
(74) *Attorney, Agent, or Firm* — Kyle A. Fletcher, Esq.

(57) ABSTRACT

The motion detector alert device comprises a detector unit and an annunciator unit. The detector unit comprises a threaded base and a threaded socket. The threaded base of the detector unit screws into a motion sensing light fixture in place of the bulb. The bulb screws into the threaded socket. The detector unit monitors electrical energy passing from the motion sensing light fixture to the bulb and transmits a signal when the light fixture energizes the bulb. The annunciator unit may be located inside of a building. Responsive to reception of the signal sent from the detector unit, the annunciator unit may produce an audible sound to alert occupants of the building that motion has been sensed outside.

19 Claims, 3 Drawing Sheets

MOTION DETECTOR ALERT DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of home security, more specifically, a motion detector alert device.

SUMMARY OF INVENTION

The motion detector alert device comprises a detector unit and an annunciator unit. The detector unit comprises a threaded base and a threaded socket. The threaded base of the detector unit screws into a motion sensing light fixture in place of the bulb. The bulb screws into the threaded socket. The detector unit monitors electrical energy passing from the motion sensing light fixture to the bulb and transmits a signal when the light fixture energizes the bulb. The annunciator unit may be located inside of a building. Responsive to reception of the signal sent from the detector unit, the annunciator unit may produce an audible sound to alert occupants of the building that motion has been sensed outside.

An object of the invention is to alert occupants of a building that a motion sensing light fixture has been activated.

Another object of the invention is to provide a detector unit that monitors activation of the bulb in a motion sensing light fixture and transmits a signal to an annunciator unit when the bulb is energized.

A further object of the invention is to produce an audible sound from an annunciator unit in response to reception of a signal from the detector unit.

Yet another object of the invention is to allow the use of multiple detector units with a single annunciator unit.

These together with additional objects, features and advantages of the motion detector alert device will be readily apparent to those of ordinary skill in the art upon reading the following detailed description of the presently preferred, but nonetheless illustrative, embodiments when taken in conjunction with the accompanying drawings.

In this respect, before explaining the current embodiments of the motion detector alert device in detail, it is to be understood that the motion detector alert device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the motion detector alert device.

It is therefore important that the claims be regarded as including such equivalent construction insofar as they do not depart from the spirit and scope of the motion detector alert device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
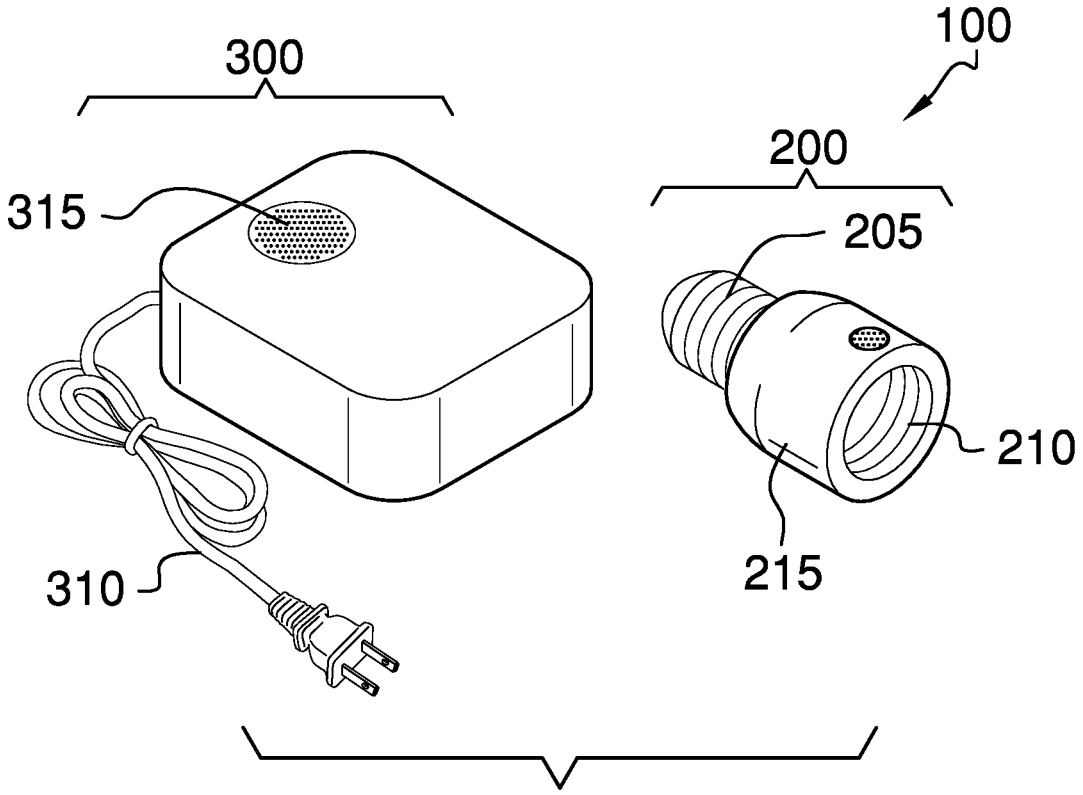
FIG. 1 is a perspective view of an embodiment of the disclosure.
Figure 2:
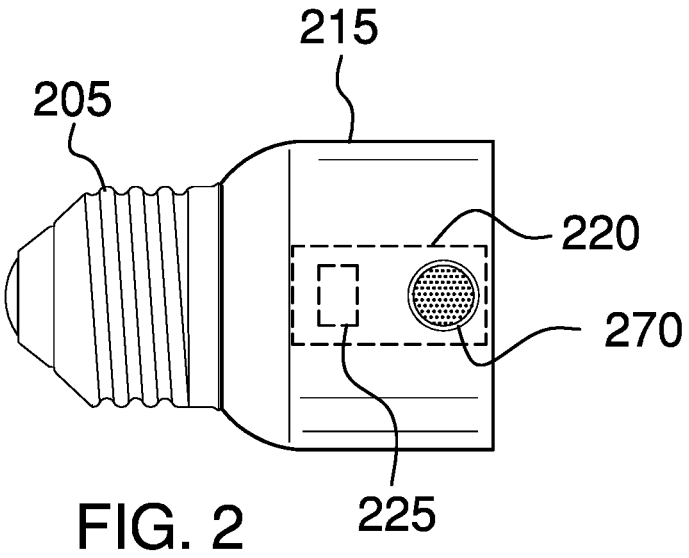
FIG. 2 is a side view of an embodiment of the disclosure illustrating the detector unit.
Figure 3:
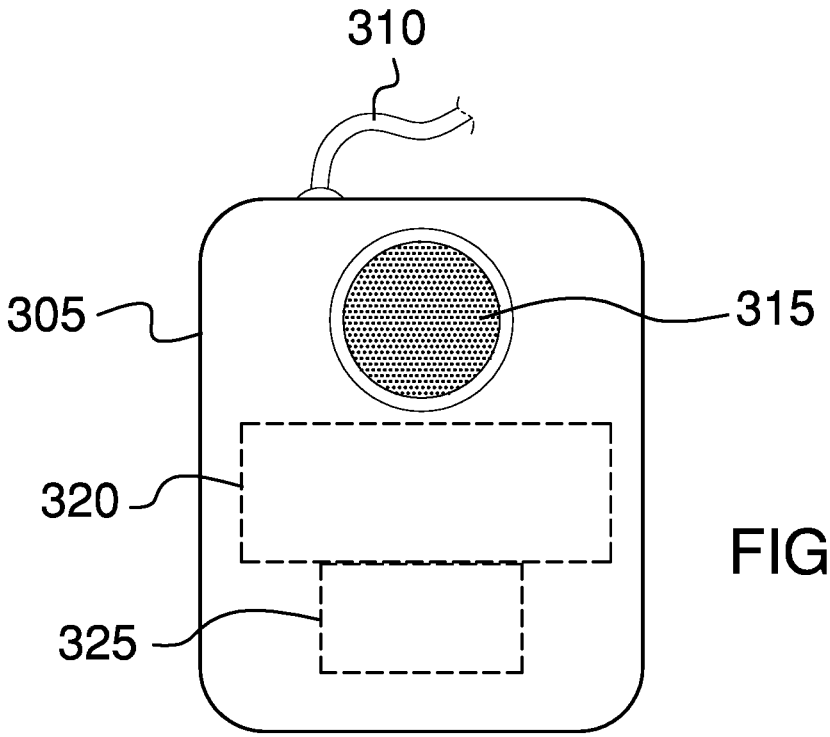
FIG. 3 is a top view of an embodiment of the disclosure illustrating the annunciator unit.
Figure 4:
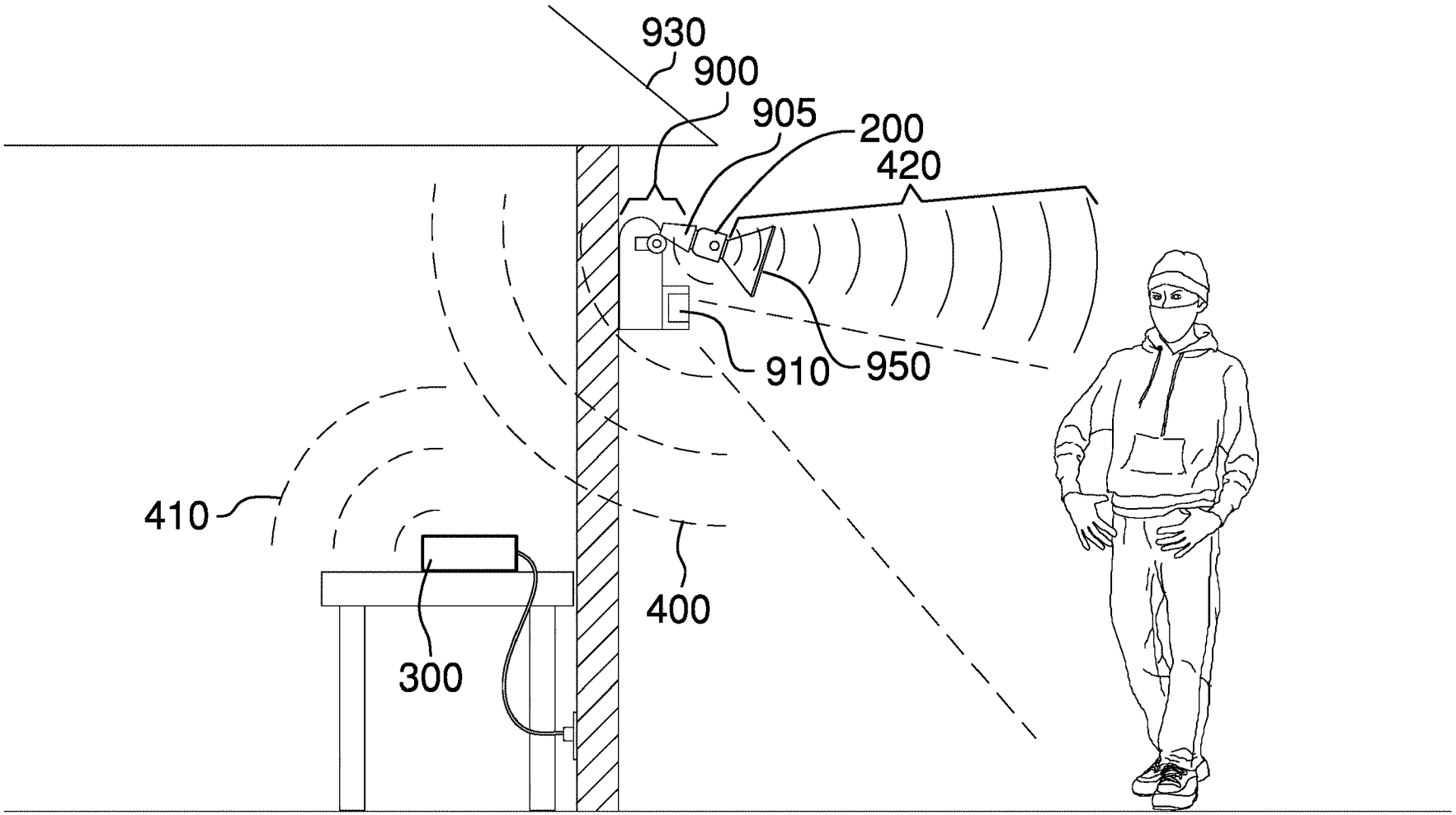
FIG. 4 is an in-use view of an embodiment of the disclosure.

Detailed reference will now be made to a first potential embodiment of the disclosure, which is illustrated in FIGS. 1 through 4.

The motion detector alert device 100 (hereinafter invention) comprises a detector unit 200 and an annunciator unit 300. The detector unit 200 may be installed in a motion sensing light fixture 900 between a fixture socket 905 and a light bulb 950. The detector unit 200 may detect that the motion sensing light fixture 900 has activated the light bulb 950 in response to detected motion. The detector unit 200 may wirelessly transmit a signal 400 to the annunciator unit 300 notifying the annunciator unit 300 of the activation of the light bulb 950. Responsive to reception of the signal 400 from the detector unit 200, the annunciator unit 300 may produce an audible sound 410.

The detector unit 200 comprises a detector housing 215, a detector screw base 205, and a detector socket 210. The detector housing 215 may be an enclosure for a control circuit 220. The detector housing 215 may be coupled to the detector screw base 205 at one end of the detector housing 215 and may be coupled to the detector socket 210 at the end of the detector housing 215 that is opposite the detector screw base 205.

The detector screw base 205 may be a threaded plug that mates with the fixture socket 905 of the motion sensing light fixture 900. The dimensions of a base thread may match an industry standard. As a non-limiting example, the base thread may be an E26 thread.

The detector socket 210 may be a threaded socket into which the light bulb 950 may be installed. The dimensions of a socket thread may match an industry standard. As a non-limiting example, the socket thread may be an E26 thread.

Electrical connections (not illustrated in the figures) may pass through the detector housing 215 between the detector screw base 205 and the detector socket 210 such that an electrical potential applied to the detector screw base 205 is transferred to the detector socket 210.

The control circuit 220 may comprise a power sensor (not illustrated in the figures) and a transmitter 225. The power sensor may detect an on/off state of the light bulb 950 that is plugged into the detector unit 200. The electrical connections between the detector screw base 205 and the detector socket 210 may be monitored by the control circuit 220 such that the control circuit 220 is aware that the motion sensing light fixture 900 has applied the electrical potential to the detector screw base 205. As non-limiting examples, the control circuit 220 may monitor the electrical current, voltage, or a combination thereof at the electrical connections.

Responsive to the power sensor determining that the light bulb 950 is in an on state, the transmitter 225 may transmit the signal 400 to the annunciator unit 300.

In some embodiments, the signal 400 may encode information conveying the on/off state of the light bulb 950.

In some embodiments, responsive to the power sensor determining that the light bulb 950 is in an off state, the transmitter 225 may transmit the signal 400 to the annunciator unit 300 conveying the on/off state of the light bulb 950.

The detector unit 200 may be installed in the fixture socket 905 of the motion sensing light fixture 900 by screwing the detector screw base 205 into the fixture socket 905 and then screwing the light bulb 950 into the detector socket 210.

The detector unit 200 is powered by electrical energy provided by the motion sensing light fixture 900 when a motion sensor 910 is activated.

In some embodiments, the detector unit 200 may comprise a supercap (not illustrated in the figures) or other energy storage device (not illustrated in the figures) to provide electrical energy to send the signal 400 to the annunciator unit 300 denoting that the motion sensing light fixture 900 has turned the light bulb 950 off.

The annunciator unit 300 comprises an annunciator control circuit 320, a receiver 325, a sound transducer 315, an annunciator housing 305, and a power connection 310. Responsive to receiving the signal 400 from the detector unit 200 that indicates that the light bulb 950 has been activated, the annunciator unit 300 may produce the audible sound 410.

As non-limiting examples, the audible sound 410 may be a tone, a sequence of tones, a pre-recorded spoken message, a spoken message produced by text to speech conversion, a pre-recorded sound clip, a musical passage, or a combination thereof.

In some embodiments, the annunciator unit 300 may produce a different sound (not illustrated in the figures) when notified that the light bulb 950 has transitioned to the off state.

The annunciator unit 300 may be placed inside of a building 930 where the audible sound 410 produced by the annunciator unit 300 may be heard.

The annunciator control circuit 320 may control the operation of the annunciator unit 300. As a non-limiting example, the annunciator control circuit 320 may select and initiate playback of the audible sound 410 when the on/off state of the light bulb 950 changes.

In some embodiments, the annunciator control circuit 320 may comprise a microprocessor, memory, I/O ports, power conditioning circuits, audio circuits, and other electronic circuitry.

The receiver 325 may detect and decode the signal 400 sent from the detector unit 200 and may notify the annunciator control circuit 320 of reception of the signal 400.

The sound transducer 315 may be a device that converts a modulated electrical signal into the audible sound 410. In some embodiments, the sound transducer 315 may be a loudspeaker. The modulated electrical signal provided to the sound transducer 315 may originate within the annunciator control circuit 320 in response to reception of the signal 400.

The annunciator housing 305 may be an enclosure for the annunciator control circuit 320, the receiver 325, and the sound transducer 315.

The power connection 310 may provide electrical energy to the annunciator unit 300 to power the annunciator control circuit 320, the receiver 325, and the sound transducer 315. The power connection 310 may be an AC line cord or a DC power adapter.

In some embodiments, the detector unit 200 may comprise a detector sound transducer 270. The detector sound transducer 270 may be a transducer physically coupled to the detector housing 215 and electrically coupled to the control circuit 220. The detector sound transducer 270 may be controlled by the control circuit 220 within the detector unit 200 such that the control circuit 220 causes the detector sound transducer 270 to produce an outside audible sound 420 whenever the detector unit 200 sends the signal 400 to notify the annunciator unit 300 that the motion sensing light fixture 900 has detected motion. The outside audible sound 420 may be produced for a pre-determined period of time or for the entire time that the light bulb 950 is on. The outside audible sound 420 may provide an additional deterrent to prowlers by warning them of an alarm system activation.

In some embodiments, the annunciator unit 300 may be used in combination with multiples of the detector unit 200. Each of the detector units 200 may encode an identifier in the signal 400 so that the annunciator unit 300 knows which of the detector units 200 sent the signal 400. The annunciator unit 300 may comprise multiples of the audible sounds 410 and may select the audible sound 410 based upon the identification sent in the signal 400. As a non-limiting example, with the detector units 200 located near the garage and near a back door, upon activation the annunciator unit 300 may play a message saying "intruder near garage" or "intruder near back door", respectively.

In use, the detector unit 200 in installed in the fixture socket 905 of the motion sensing light fixture 900 and the light bulb 950 is installed in the detector socket 210. The annunciator unit 300 is plugged into a wall outlet inside of the building 930. When the motion sensor 910 detects motion and the motion sensing light fixture 900 applies electricity to the light bulb 950, the detector unit 200 may transmit the signal 400 to the annunciator unit 300. Responsive to receiving the signal 400, the annunciator unit 300 may produce the audible sound 410.

As used in this disclosure, "AC" is an acronym for alternating current.

As used herein, the words "couple", "couples", "coupled" or "coupling", refer to connecting, either directly or indirectly, and does not necessarily imply a mechanical connection.

As used herein, the words "data" and "information" are used interchangeably to refer to raw, unprocessed facts and to facts that have been processed, structured, organized, or present in a context that makes the facts useful.

As used in this disclosure, "DC" is an acronym for direct current.

As used herein, "encode" refers to altering a signal, a message, or a dataset to embed information into the signal, the message, or the dataset. "Decode" refers to extracting or recovering the information from the signal, the message, or the dataset. By way of example and not of limitation, the purpose of encoding and decoding may be to obfuscate the information during transmission or storage, to modulate a signal, to increase the efficiency of a communications or storage medium, or to convert one format into another format.

As used in this disclosure, a "housing" is a rigid casing that encloses and protects one or more devices.

As used in this disclosure, a "light" is an electrical device that generates visible light to illuminate objects so they can be seen.

As used in this disclosure, an "outlet" is a device placed in the electrical wiring system of a building where electrical current can be taken to run electrical devices. In this disclosure, an outlet is a socket adapted to receive a plug.

As used in this disclosure, a "power connection" refers to the physical method of electrical connection that permits the delivery of energy from an electrical power source to the invention.

As used herein, the terms "processor", "central processor", "central processing unit", "CPU", or "microprocessor" refer to a digital device that carries out the instructions comprising a computer program by performing basic arithmetic, logical, control, and input/out operations. The term "microprocessor" may additionally imply a level of miniaturization and power reduction that makes the device suitable for portable or battery operated systems.

As used in this disclosure, a "sensor" is a device that quantitatively measures a physical stimulus.

As used in this disclosure, a "speaker" is an electrical transducer that converts an electrical signal into an audible sound; also known as a loudspeaker.

As used herein, "supercap", "supercapacitor", "electrical double layer capacitor", "EDLC", or "ultracapacitor" refers to a type of capacitor used mainly to store electrical energy. Unlike a regular capacitor, supercaps generally have much larger plates that are much closer together. Supercaps may have capacities that are thousand of farads, as opposed to picofarad, nanofarad, microfarad capacities of other capacitors.

As used in this disclosure, a "transducer" is a device that converts a physical quantity, such as pressure or brightness into an electrical signal or a device that converts an electrical signal into a physical quantity.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A motion detector alert device comprising:

a detector unit and an annunciator unit;

wherein the detector unit is installed in a motion sensing light fixture between a fixture socket and a light bulb;

wherein the detector unit detects that the motion sensing light fixture has activated the light bulb in response to detected motion;

wherein the detector unit wirelessly transmits a signal to the annunciator unit notifying the annunciator unit of the activation of the light bulb;

wherein responsive to reception of the signal from the detector unit, the annunciator unit produces an audible sound.

2. The motion detector alert device according to claim 1 wherein the detector unit comprises a detector housing, a detector screw base, and a detector socket;

wherein the detector housing is an enclosure for a control circuit;

wherein the detector housing is coupled to the detector screw base at one end of the detector housing and is coupled to the detector socket at the end of the detector housing that is opposite the detector screw base.

3. The motion detector alert device according to claim 2 wherein the detector screw base is a threaded plug that mates with the fixture socket of the motion sensing light fixture;

wherein the detector socket is a threaded socket into which the light bulb is installed;

wherein electrical connections passes through the detector housing between the detector screw base and the detector socket such that an electrical potential applied to the detector screw base is transferred to the detector socket.

4. The motion detector alert device according to claim 3 wherein the control circuit comprises a power sensor and a transmitter;

wherein the power sensor detects an on/off state of the light bulb that is plugged into the detector unit;

wherein the electrical connections between the detector screw base and the detector socket are monitored by the control circuit such that the control circuit is aware that the motion sensing light fixture has applied the electrical potential to the detector screw base.

5. The motion detector alert device according to claim 4 wherein responsive to the power sensor determining that the light bulb is in an on state, the transmitter transmits the signal to the annunciator unit.

6. The motion detector alert device according to claim 5 wherein the detector unit is installed in the fixture socket of the motion sensing light fixture by screwing the detector screw base into the fixture socket and then screwing the light bulb into the detector socket.

7. The motion detector alert device according to claim 6 wherein the detector unit is powered by electrical energy provided by the motion sensing light fixture when a motion sensor is activated.

8. The motion detector alert device according to claim 7 wherein the detector unit comprises a supercap or other energy storage device to provide electrical energy to send the signal to the annunciator unit denoting that the motion sensing light fixture has turned the light bulb off.

9. The motion detector alert device according to claim 7 wherein the annunciator unit comprises an annunciator control circuit, a receiver, a sound transducer, an annunciator housing, and a power connection;

wherein responsive to receiving the signal from the detector unit that indicates that the light bulb has been activated, the annunciator unit produces the audible sound.

10. The motion detector alert device according to claim 9 wherein the annunciator control circuit controls the operation of the annunciator unit;

wherein the receiver detects and decodes the signal sent from the detector unit and notifies the annunciator control circuit of reception of the signal.

11. The motion detector alert device according to claim 10 wherein the annunciator control circuit comprises a microprocessor, memory, I/O ports, power conditioning circuits, and audio circuits.

12. The motion detector alert device according to claim 10 wherein the sound transducer is a device that converts a modulated electrical signal into the audible sound.

13. The motion detector alert device according to claim 12 wherein the modulated electrical signal provided to the sound transducer originates within the annunciator control circuit in response to reception of the signal.

14. The motion detector alert device according to claim 13 wherein the annunciator housing is an enclosure for the annunciator control circuit, the receiver, and the sound transducer.

15. The motion detector alert device according to claim 14 wherein the power connection provides electrical energy to the annunciator unit to power the annunciator control circuit, the receiver, and the sound transducer.

16. The motion detector alert device according to claim 15 wherein the signal encodes information conveying the on/off state of the light bulb;

wherein responsive to the power sensor determining that the light bulb is in an off state, the transmitter transmits the signal to the annunciator unit conveying the on/off state of the light bulb.

17. The motion detector alert device according to claim 16 wherein the annunciator unit produces a different sound when notified that the light bulb has transitioned to the off state.

18. The motion detector alert device according to claim 15 wherein the detector unit comprises a detector sound transducer;

wherein the detector sound transducer is a transducer physically coupled to the detector housing and electrically coupled to the control circuit;

wherein the detector sound transducer is controlled by the control circuit within the detector unit such that the control circuit causes the detector sound transducer to produce an outside audible sound whenever the detector unit sends the signal to notify the annunciator unit that the motion sensing light fixture has detected motion.

19. The motion detector alert device according to claim 15 wherein the annunciator unit is used in combination with multiples of the detector unit;

wherein each of the detector units encodes an identifier in the signal so that the annunciator unit knows which of the detector units sent the signal;

wherein the annunciator unit comprises multiples of the audible sounds and selects the audible sound based upon the identification sent in the signal.

* * * * *